US006854409B1

(12) United States Patent
Galliano

(10) Patent No.: US 6,854,409 B1
(45) Date of Patent: Feb. 15, 2005

(54) ROTARY ELECTROMAGNETIC LAUNCH TUBE

(75) Inventor: Carlos E. Galliano, North Kingstown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 87 days.

(21) Appl. No.: 10/456,140

(22) Filed: Jun. 6, 2003

(51) Int. Cl.[7] ..... F41F 3/10; F41F 3/07; B63G 8/32

(52) U.S. Cl. ..... 114/238; 114/239; 114/319; 89/5

(58) Field of Search ..... 114/238, 239, 114/316, 318, 319; 89/5

(56) References Cited

U.S. PATENT DOCUMENTS 4,971,949 A * 11/1990 Laskaris et al. ..... 505/164
5,044,253 A * 9/1991 Moody ..... 89/1.81
5,099,745 A * 3/1992 Hubbell et al. ..... 89/1.81
5,284,106 A * 2/1994 Meng ..... 114/238
5,834,674 A * 11/1998 Rodriguez et al. ..... 89/1.81
5,957,668 A * 9/1999 Moody ..... 417/326
6,220,196 B1 * 4/2001 Escarrat ..... 114/238
6,502,528 B1 * 1/2003 MacLeod et al. ..... 114/319

FOREIGN PATENT DOCUMENTS

GB 2379416 A * 3/2003 ..... F41F/3/10

* cited by examiner

*Primary Examiner*—Michael J. Carone
*Assistant Examiner*—James S. Bergin
(74) *Attorney, Agent, or Firm*—James M. Kasischke; Michael F. Oglo; Jean-Paul A. Nasser

(57) ABSTRACT

An underwater launch system includes a launch tube frangibly sealed at its forward end. At launch time, pressure equalization means introduces water at depth pressure into the launch tube between its frangibly sealed ends. A rotary electromagnetic pump coupled to the launch tube receives water at depth and expels the water at a higher pressure. The higher pressure water is coupled to the aft end of the launch tube.

15 Claims, 1 Drawing Sheet

ROTARY ELECTROMAGNETIC LAUNCH TUBE

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to underwater launching, and more particularly to a self-contained underwater launch system that uses a rotary electromagnetic pump to provide a launch impulse.

(2) Description of the Prior Art

A submarine's weapons and other devices are currently launched underwater by one of a horizontal or vertical launch system. The horizontal launch system is used to launch a payload (e.g., torpedo, sonobuoy, unmanned underwater vehicle, mines, etc.) into the water whereas a vertical launch system is used to launch a payload (e.g., missile, signaling device, etc.) into the air. The horizontal launch system typically consists of horizontally positioned pairs of tubes with each pair being connected by an impulse tank structure that directs water flow from an ejection pump to each of the tubes. The aft end of each tube is located in the submarine's torpedo room which is inside the submarine's pressure hull. Thus, the tube (which must accommodate payloads up to 21 inches in diameter) must penetrate the pressure hull. Due to the inherent risk associated with such large pressure hull penetrations, a submarine's torpedo room is one of the most complicated and expensive aspects of submarine design and construction.

Vertical launch systems make use of vertically oriented tubes positioned in the submarine's forward end external to the pressure hull. Launch is achieved using gas generators built into each tube. However, the use of such gas generators is loud and environmentally hazardous. Further, since the horizontal and vertical launch systems operate using different systems/principles, the overall complexity and cost of a submarine is increased when both types of launching must be accommodated in a single vessel.

SUMMARY OF THE INVENTION

Accordingly, it is an object of the present invention to provide a launch system that can be used to effect both a horizontal and vertical launch from a submarine.

Another object of the present invention is to provide an underwater launch system that reduces the complexity and cost associated therewith by minimizing the size of any pressure hull penetrations used in the construction of the launch system.

Still another object of the present invention is to provide an underwater launch system having a controllable source of launch impulse power so that a minimum launch impulse energy is used, thereby minimizing the acoustic signature associated with a launch.

Other objects and advantages of the present invention will become more obvious hereinafter in the specification and drawings.

In accordance with the present invention, an underwater launch system is provided for mounting outside of an underwater vessel's pressure hull. A launch tube (housing a payload) is frangibly sealed at its forward and aft ends. Pressure equalization means coupled to the launch tube between the forward and aft ends introduces water at depth pressure into the launch tube just prior to launch time. A restraining device such as a stopbolt in the launch tube restrains the payload until released just prior to launch. A rotary electromagnetic pump has its input side in communication with water at depth pressure and its output side coupled to the frangibly sealed aft end of the launch tube. The input side receives water at depth while the output side expels the water at a second pressure that is greater than depth pressure. When the stopbolt releases the payload, the higher pressure water acts on the payload and causes same to be driven through the frangibly sealed forward end of the launch tube.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DESCRIPTION OF THE PREFERRED EMBODIMENT(S)

Figure 1:
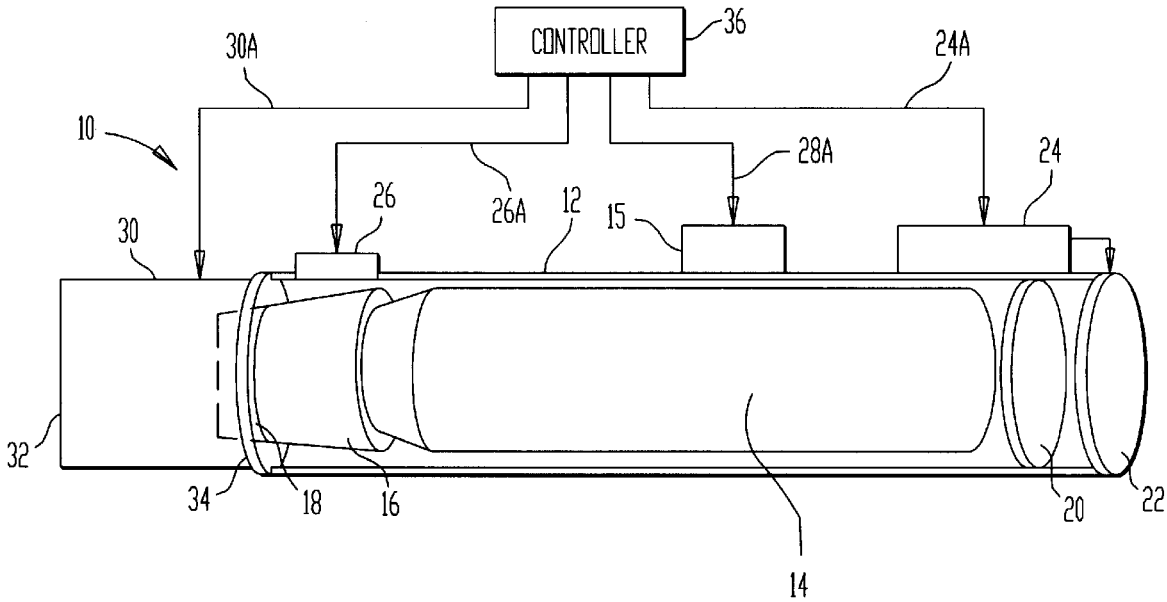
FIG. 1 is a side schematic view of a rotary electromagnetic launch tube self-contained underwater launch system in accordance with the present invention.

Referring now to the drawings, and more particularly to FIG. 1, a self-contained underwater launch system according to the present invention is shown and referenced generally by numeral 10. Launch system 10 is designed to be used externally with respect to a submarine's pressure hull in either a horizontal or vertical orientation. The particular payload launched by system 10 and/or its support platform (e.g., ship, submarine, buoy, etc.) are not limitations of the present invention.

Launch system 10 has a launch capsule or tube 12 housing a payload 14 therein which can have a propulsor 16 coupled to its aft end. Payload 14 is any payload that is to be launched into a surrounding water environment where it will then run its entire course or transition into the air for airborne travel. Prior to launch time, payload 14 is held in place by an axial restraining lock or stopbolt 15, a variety of which are well known in the art. As shown here, stopbolt 15 is operated by an electrical actuator requiring only electrical signal and power lines 28A for operation.

Up until launch time, payload 14 is kept dry by a combination of tube 12 and sealing mechanisms mounted or coupled to tube 12 fore and aft of payload 14. For example, in the illustrated embodiment, an aft seal 18 seals the aft or breech end of tube 12 and a forward seal 20 seals the forward or muzzle end of tube 12. Each of seals 18 and 20 is strong enough to withstand the specified operating depth pressure of launch system 10. Aft seal 18 is a face seal on the breech end of the tube that sealingly mates with the outer surface of propulsor 16 on payload 14. This sealing relationship is maintained as payload 14 is restrained axially by stopbolt 15. Forward seal 20 is a diaphragm with a built in tear strip (not shown) that will rupture when payload 14 is impulsed through it.

Although not necessarily required, a muzzle door 22 can be coupled to tube 12 further forward of forward seal 20 to insure the integrity of forward seal 20 until launch time. If muzzle door 22 is used, opening and closing thereof is achieved with an actuator 24 which, preferably, is an electro or electromagnetic type of actuator requiring only electrical signal and power lines 24A for operation.

Just prior to launch of payload 14, tube 12 between seals 18 and 20 is flooded with water at depth pressure. This can be accomplished by means of a controllable valve 26 coupled to tube 12 between seals 18 and 20. Note that valve 26 need not be mounted directly in tube 12 as illustrated, but may be incorporated in a conduit (not shown) coupling launch tube 12 and the surrounding water at depth pressure. Preferably, valve 26 is an electrically-operated valve requiring only electrical signal and power lines 26A for operation. The combination of seals 18 and 20 with valve 26 provide tube 12 the means to equalize its interior pressure to depth pressure just prior to launch of payload 14.

Launch system 10 further includes a rotary electromagnetic pump 30 that receives its controlling signals and power via lines 30A. Pump 30 has an input side 32 for receiving water at depth pressure, and an output side 34 for expelling water at a pressure that is greater than depth pressure. Immediately prior to launch, stopbolt 15 is actuated thereby releasing payload 14 in launch tube 12. Output side 34 is coupled to launch tube 12 (e.g., via direct coupling thereto or via a connecting conduit) so that the higher pressure expelled water is delivered to payload 14 impulsing it forward to break the seat with aft seal 18. Such impulse energy drives payload 14 forward through forward seal 20. To minimize transmission losses, pump 30 is +axially aligned with launch tube 12, i.e., input side 32 and output side 34 are in axial alignment with launch tube 12.

Control signal and power supplied on lines 24A, 26A, 28A and 30A can be supplied by a controller 36 maintained on or within the launch system's support platform. In terms of a support platform that is an underwater vessel, controller 36 can be maintained within the vessel's pressure hull. Since each of the controllable elements of launch system 10 only requires electric signals and power, the lines carrying such signals and power (i.e., lines 24A, 26A, 28A, 30A) can be contained within a single conduit that requires a small pressure hull penetration.

Figure 2:
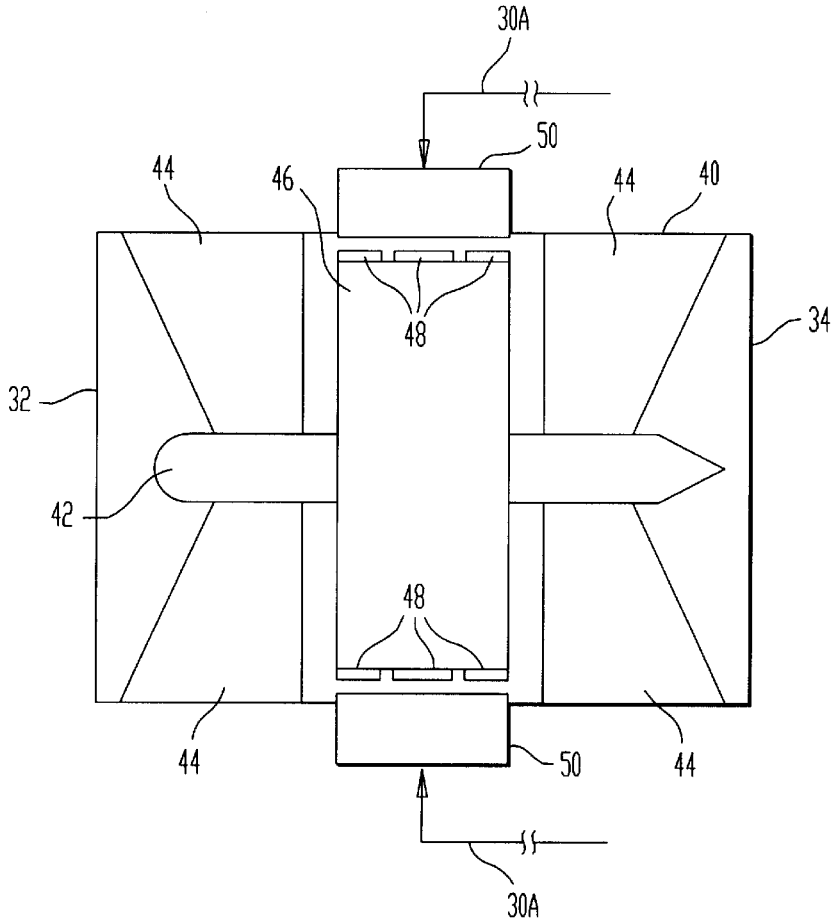
FIG. 2 is a side schematic view of a rotary electromagnetic pump used in the launch system of the present invention.

Rotary electromagnetic pump 30 is illustrated in greater detail in FIG. 2. A pump housing 40 is open at either end thereof to define a (typically) cylindrical tube having an input side 32 and output side 34. A support shaft 42 is axially supported in housing 40 by means of a plurality of radial mounts 44 which are typically hydrodynamically shaped in any one of a variety of ways as would be understood by one of ordinary skill in the art. A shrouded impeller 46 is rotationally mounted on shaft 42. Impeller 46 is designed to propel fluid (water) axially therethrough when rotated as is well known in the art. The particular number of impeller blades (not shown) of impeller 46 and blade shape are not limiting features of the present invention. Affixed to the outer portion of the shroud of impeller 46 are a number of permanent magnets 48. The number, size and/or configuration of magnets 48 are not limitations of the present invention. Mounted to housing 40 is an electric field generator 50 (e.g., coils) that receives electrical current on lines 30A. The interaction of the magnetic field produced by magnets 48 with the electric field produced by generator 50 causes impeller 46 to rotate on shaft 42.

The amount of pressure needed at output side 34 will vary depending on a variety of factors such as the type of payload 14, covertness requirements of a launch, and speed of the ship supporting launch system 10. Accordingly, to make launch system 10 adaptable to a variety of applications/situations, rotary electromagnetic pump 30 is a variable speed pump. That is, speed of adjustment is controlled by the electrical current supplied to electric field generator 50. Such speed control is monitored and governed by signals/current supplied over lines 30A.

The advantages of the present invention are numerous. Since only a single signal/power line conduit is needed to bring control signals and power to the launch system, a vessel's pressure hull penetration to support the launch system is greatly reduced when compared to a conventional torpedo tube.

Furthermore, the present invention provides a viable means to store and launch payloads external to a submarine's pressure hull. The dedicated integral motor pump eliminates the need for impulse tank structure and slide valve assemblies found on current torpedo tubes thereby saving cost, weight and complexity. The present invention is independent of high-pressure air and hydraulics since it relies upon electric power to actuate all mechanisms and the rotary electromagnetic pump. Since the rotary electromagnetic pump has a high degree of controllability, an optimized launch pulse can be tailored for each payload as well as any given ship condition (e.g., depth and/or speed) to ensure that the minimum energy required is applied and thereby minimize the system's acoustic signature.

An additional advantage is that multiple launch tubes can be packaged together for increased payload density. Further, since each tube is autonomous, system reliability is increased compared to existing systems because failure of any given launcher does not impact the availability of any other launcher.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An underwater launch system mounted outside of an underwater vessel's pressure hull, said system comprising:

a launch tube for housing a payload, said launch tube having an aft end and a frangibly sealed forward end;

pressure equalization means coupled to said launch tube between said forward and aft ends thereof for introducing water at depth pressure into said launch tube; and a rotary electromagnetic pump having an input side for receiving a fluid at a first pressure and an output side for expelling said fluid at a second pressure that is greater than said first pressure, said input side in communication with water at depth pressure and said output side coupled to said aft end.

2. An underwater launch system as in claim 1 wherein said input side and said output side of said rotary electromagnetic pump are axially aligned with said launch tube.

3. An underwater launch system as in claim 1 wherein said rotary electromagnetic pump is a variable speed pump, and wherein said launch system further comprises means for controlling speed of said rotary electromagnetic pump wherein said second pressure is controlled.

4. An underwater launch system as in claim 1 further comprising a restraining assembly joined to said launch tube to selectably restrain the payload.

5. An underwater launch system as in claim 1 wherein said rotary electromagnetic pump comprises:

a housing coupled to said aft end of said launch tube, said housing defining a cylindrical tube with one end thereof forming said input side and another end thereof forming said output side;

electric field generating means mounted in said housing at a circumferential portion thereof;

an impeller rotationally mounted in said housing for rotational movement in said circumferential portion, said impeller having a periphery that is spaced apart from said electric field generating means; and magnetic field generating means mounted to said periphery of said impeller and spaced apart from said electric field generating means.

6. An underwater launch system mounted outside of an underwater vessel's pressure hull, said system comprising:

a launch tube for housing a payload, said launch tube having a forward end and an aft end;

a rupturable seal coupled to and sealing said forward end;

a face seal coupled between said launch tube and the payload for sealing said aft end against the payload;

means coupled to said launch tube for introducing water at depth pressure into said launch tube between said rupturable seal and said face seal; and a rotary electromagnetic pump having an input side for receiving a fluid at a first pressure and an output side for expelling said fluid at a second pressure that is greater than said first pressure and said depth pressure, said rotary electromagnetic pump maintained external to said launch tube with said input side thereof in communication with water at depth pressure and said output side thereof coupled to said launch tube.

7. An underwater launch system as in claim 6 wherein said input side and said output side of said rotary electromagnetic pump are axially aligned with said launch tube.

8. An underwater launch system as in claim 6 wherein said rotary electromagnetic pump is a variable speed pump, and wherein said launch system further comprises means for controlling speed of said rotary electromagnetic pump wherein said second pressure is controlled.

9. An underwater launch system as in claim 6 wherein said rotary electromagnetic pump comprises:

a housing coupled to said aft end of said launch tube, said housing defining a cylindrical tube with one end thereof forming said input side and another end thereof forming said output side;

electric field generating means mounted in said housing at a circumferential portion thereof;

an impeller rotationally mounted in said housing for rotational movement in said circumferential portion, said impeller having a periphery that is spaced apart from said electric field generating means; and magnetic field generating means mounted to said periphery of said impeller and spaced apart from said electric field generating means.

10. An underwater launch system as in claim 6 further comprising a restraining assembly joined to said launch tube to selectably restrain the payload.

11. An underwater launch system mounted outside of an underwater vessel's pressure hull, said system comprising:

a launch tube for housing a payload, said launch tube having a muzzle and a breech;

a door coupled to said muzzle;

an electrical actuator coupled to said door for opening and closing same;

a rupturable seal mounted inside said launch tube forward of the payload;

a face seal coupled between said launch tube and the payload for sealing said breech;

an electrically-operated valve coupled to said launch tube for permitting water at depth pressure to be introduced into said launch tube between said rupturable seal and said face seal; and a rotary electromagnetic pump having an input side for receiving a fluid at a first pressure and an output side for expelling said fluid at a second pressure that is greater than said first pressure and said depth pressure, said rotary electromagnetic pump maintained external to said launch tube with said input side thereof in communication with water at said depth pressure and said output side thereof coupled to said face seal.

12. An underwater launch system as in claim 11 wherein said input side and said output side of said rotary electromagnetic pump are axially aligned with said launch tube.

13. An underwater launch system as in claim 11 wherein said rotary electromagnetic pump is a variable speed pump, and wherein said launch system further comprises means for controlling speed of said rotary electromagnetic pump wherein said second pressure is controlled.

14. An underwater launch system as in claim 11 further comprising a restraining assembly joined to said launch tube to selectably restrain the payload.

15. An underwater launch system as in claim 11 wherein said rotary electromagnetic pump comprises:

a housing coupled to said aft end of said launch tube, said housing defining a cylindrical tube with one end thereof forming said input side and another end thereof forming said output side;

electric field generating means mounted in said housing at a circumferential portion thereof;

an impeller rotationally mounted in said housing for rotational movement in said circumferential portion, said impeller having a periphery that is spaced apart from said electric field generating means; and magnetic field generating means mounted to said periphery of said impeller and spaced apart from said electric field generating means.

* * * * *